US007463210B2

(12) United States Patent
Rawnick et al.

(10) Patent No.: US 7,463,210 B2
(45) Date of Patent: Dec. 9, 2008

(54) PHASED ARRAY ANTENNA FORMED AS COUPLED DIPOLE ARRAY SEGMENTS

(75) Inventors: James J. Rawnick, Palm Bay, FL (US); Christopher Trent, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 112 days.

(21) Appl. No.: 11/696,933

(22) Filed: Apr. 5, 2007

(65) Prior Publication Data

US 2008/0246680 A1 Oct. 9, 2008

(51) Int. Cl.
*H01Q 9/28* (2006.01)
*H01Q 21/26* (2006.01)

(52) U.S. Cl. ..... 343/795; 343/797

(58) Field of Classification Search ..... 343/700 MS, 343/802, 813, 824, 827, 795, 797
See application file for complete search history.

(56) References Cited

U.S. PATENT DOCUMENTS

| | | | | |
|---|---|---|---|---|
| 3,995,277 | A | 11/1976 | Olyphant, Jr. | 343/846 |
| 5,485,167 | A | 1/1996 | Wong et al. | 343/753 |
| 5,802,534 | A | 9/1998 | Hatayama et al. | 715/530 |
| 6,417,813 | B1 | 7/2002 | Durham | 343/753 |
| 6,512,487 | B1 * | 1/2003 | Taylor et al. | 343/795 |
| 6,678,866 | B1 | 1/2004 | Sugimoto et al. | 715/517 |
| 6,686,885 | B1 | 2/2004 | Barkdoll et al. | 343/700 |
| 6,804,684 | B2 | 10/2004 | Stubler et al. | 707/102 |
| 6,822,616 | B2 | 11/2004 | Durham et al. | 343/795 |
| 6,856,297 | B1 * | 2/2005 | Durham et al. | 343/795 |
| 2005/0030246 | A1 | 2/2005 | Durham et al. | 343/795 |

FOREIGN PATENT DOCUMENTS

WO WO03/098743 11/2003

* cited by examiner

*Primary Examiner*—Shih-Chao Chen
(74) *Attorney, Agent, or Firm*—Allen, Dyer, Doppelt, Milbrath & Gilchrist, P.A.

(57) ABSTRACT

A phased array antenna includes a substrate that is segmented into a plurality of array tiles. An array of dipole antenna elements is formed on the substrate with each dipole antenna element positioned on a respective one of the array tiles. Each dipole antenna element includes a medial feed portion and a pair of legs extending outwardly therefrom. Adjacent legs of adjacent dipole antenna elements include respective spaced apart end portions forming a gap between the respective end portions and defined by separate tiles. A capacitor coupler is positioned at each respective spaced apart end portion of adjacent legs and bridging a gap for capacitive coupling respective spaced apart end portions of respective adjacent dipole antenna elements together.

20 Claims, 11 Drawing Sheets d = dielectric layer
cp = coupling plane
g = ground plane
a = adhesive layer
csa = current sheet array or dipole layer

PHASED ARRAY ANTENNA FORMED AS COUPLED DIPOLE ARRAY SEGMENTS

GOVERNMENT LICENSE RIGHTS

This invention was made with Government support under a proprietary government contract awarded by the U.S. Government.

FIELD OF THE INVENTION

The present invention relates to the field of communications, and more particularly, the present invention relates to phased array antennas.

BACKGROUND OF THE INVENTION

Lightweight phased array antennas having a wide frequency bandwidth and a wide scan angle can be economically manufactured and conformally mounted on a surface, such as a nose cone of an aircraft. Examples of such antenna include a current sheet array (CSA) formed of at least one dipole layer and using coupling capacitors between antenna dipole elements. The capacitors often are formed as interdigitated "fingers." The coupling capacitance between dipole elements can be increased by lengthening the capacitor "digits" or "fingers," which results in additional bandwidth for the antenna. An example of this type of structure is disclosed in commonly assigned U.S. Pat. No. 6,417,813 to Durham, the disclosure which is hereby incorporated by reference in its entirety.

A similar phased array antenna is disclosed in commonly assigned U.S. Pat. No. 6,822,616 to Durham et al., which overcomes the significant gain drop-out with some frequencies at a desired operational bandwidth. That disclosed antenna provides a lightweight phased array antenna with a wide frequency bandwidth and wide scan angle that is still conformally mountable on a surface and not subject to a gain drop-out. It can include a feed-through lens antenna to replicate an electromagnetic (EM) environment, and provide a high pass filter response. As disclosed in the '813 and '616 patents, the antenna is a connected array that relies on capacitive coupling between adjacent dipole antenna elements.

Often these types of phased array antennas are formed as large arrays, often with subarrays, and operable in the 2.0 through 18.0 GHz range. They can be constructed from different modules with separate array panels, for example, each about 12×18 inches and forming an antenna aperture. They can be constructed with an interdigitated assembly of various beam former components, subarray beam formers, transmit/receive modules and associated components, with connections that are ribbon bonded to antenna feed portions and associated legs extending outward therefrom. The antenna elements form the dipoles. As a result, these phased array antenna structures have an array of tightly packed and closely spaced dipole elements connected to neighboring dipole elements through capacitor coupling, as set forth in the above-identified and incorporated by reference '616 and '813 patents. The antenna can have dual polarization by using horizontal and vertical dipole elements and solder connections at feed points. The capacitor coupling imparts a broadband performance, and can be formed using interdigitated or in some cases end-coupled capacitor elements. The interdigitated capacitor elements have lengthened "fingers" to increase capacitance. Increasing the length of fingers, however, can be problematic because the structure becomes resonant. Thus, edge coupling may be used.

Even with the performance advantages provided by this type of phased array antenna structure, it would be desirable to form the array in a manner that makes such arrays more easily repairable since entire arrays often must be scrapped if one antenna dipole element is defective.

SUMMARY OF THE INVENTION

A phased array antenna includes a substrate that is segmented into a plurality of array tiles. An array of dipole antenna elements are formed on the substrate with each dipole antenna element positioned on a respective one of the array tiles. Each dipole antenna element includes a medial feed portion and a pair of legs extending outwardly therefrom. Adjacent legs of adjacent dipole antenna elements include respective spaced apart end portions forming a gap between the respective end portions and defined by separate tiles. A capacitor coupler is positioned at each respective spaced apart end portion of adjacent legs and bridging a gap for capacitive coupling respective spaced apart end portions of respective adjacent dipole antenna elements together.

In one aspect, the capacitor coupler can be formed as a support member and conductive sheet thereon. The support member can be formed as a polyamide film layer and can include a periphery that extends behind the conductive sheet to permit attachment by pick-and-place assembly equipment. The support member can be about 5 mils thick and about 80 by about 30 mils.

In yet another aspect, respective spaced apart end portions of adjacent legs define an air gap. The array of dipole elements can be formed by first and second sets of orthogonal dipole antenna elements to provide dual polarization. The substrate and array of dipole elements can be formed as a current sheet array.

In yet another aspect, at least one dielectric layer can be applied adjacent a ground plane such that the dielectric layer is positioned between the ground plane and the substrate.

A method aspect is also set forth.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
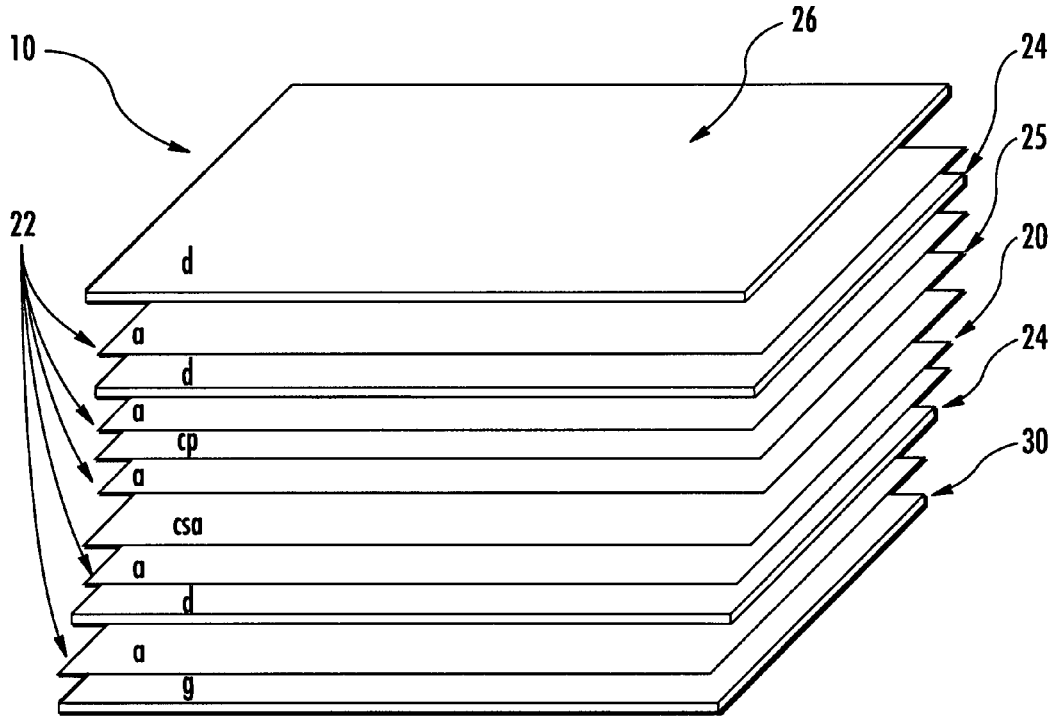
FIG. 1 is an exploded view of a wideband phased array antenna such as disclosed in the above-identified and incorporated by reference '616 patent.

Different embodiments will now be described more fully hereinafter with reference to the accompanying drawings, in which preferred embodiments are shown. Many different forms can be set forth and described embodiments should not be construed as limited to the embodiments set forth herein. Rather, these embodiments are provided so that this disclosure will be thorough and complete, and will fully convey the scope to those skilled in the art. Like numbers refer to like elements throughout.

A phased array antenna, in accordance with a non-limiting example of the present invention, overcomes the problems associated with a construction where no acceptable cut-lines can segment the antenna structure to form array "tiles," which would allow the array to be more easily manufacturable and repairable. For example, it is not possible to cut through any feed point (feed lines) because this is a sensitive area of the antenna where feed characteristics and impedances are important. Any cut-lines in these areas could severely degrade antenna performance. It is also not possible to cut through the capacitors, as this would destroy the carefully designed coupling between antenna dipole elements.

Forming any segment or array "tiles" from individual antenna dipole elements is made even more difficult because current sheet array antennas are assembled as a complete array, requiring procurement and manufacture of large printed wiring boards (PWB's) and/or foam spacers in a ground plane. It is often not possible to repair one antenna dipole element, and as a result, in some cases, an entire array panel must be scrapped.

For example, in one type of phased array antenna formed as a current sheet array, there are 512 elements, forming a 16×16 inch current sheet array aperture aligned to a single piece of foam, which is aligned to a ground plane with thousands of features. The manufacture of such a phased array antenna is difficult and labor intensive and not easily repairable once assembled.

A wideband phased array antenna, in accordance with a non-limiting example of the present invention, is segmented into individual array "tiles" corresponding to each antenna dipole element, using cut lines from the substrate as part of the aperture to the ground plane. A metallized, add-on capacitor coupler is formed as a separate "appliance" and could be formed with a support member and conductive sheet thereon. It covers the air gap and forms the capacitor coupling for only adjacent antenna dipole elements.

This antenna structure incorporates the desired capacitor coupling using a capacitor coupler. A support member can carry a conductive sheet forming the capacitor coupler. The support member has a periphery that can be attached by equipment for robust pick-and-place assembly. Of course, other designs could be used, including metallized tape patterns or metallized plastic film, as well as other techniques for forming the functional capacitor coupler. Because of the use of the cut-lines and capacitor coupler, a larger array can be formed into smaller, more manufacturable, array "tiles" or segments corresponding to individual dipole antenna elements while maintaining coupling between dipole elements as necessary. The addition of the capacitor coupler to the modular design ensures that the antenna performance does not degrade below specification. This design can be used with any current sheet array (CSA) antenna regardless of size or number of elements. Although the incorporated by reference '616 patent has a long interdigital capacitor for increased capacitance, it is not amenable for use as a modular array.

Referring now to FIGS. 1-5 details of a multilayer, capacitive coupling structure and phased array antenna such as disclosed in the incorporated by reference '616 patent, are now set forth as background to understand better the phased array antenna in accordance with a non-limiting example of the present invention. This design may incorporate separate layers for additional capacitive coupling.

A wideband phased array antenna 10, as set forth in the incorporated by reference '616 patent, is illustrated. The antenna 10 may be mounted on a nosecone or other rigid mounting member having either a planar or a non-planar three-dimensional shape, for example, an aircraft or spacecraft, and may also be connected to a transmission and reception controller (not shown) as would be appreciated by one skilled in the art.

The wideband phased array antenna 10 is preferably formed of a plurality of flexible layers. These layers include a dipole layer 20 or current sheet array, which is sandwiched between a ground plane 30 and an outer dielectric layer 26, such as an outer dielectric layer formed of foam. Other dielectric layers 24 (preferably made of foam or similar material) may be provided in between, as illustrated. Additionally, the phased array antenna 10 includes at least one coupling plane 25. It should be understood that the coupling plane can be embodied in many different forms, including coupling planes that are fully or partially metallized, coupling planes that reside above or below the dipole layer 20, or multiple coupling planes that can reside either above or below the dipole layer or both.

Respective adhesive layers 22 secure the dipole layer 20, ground plane 30, coupling plane 25, and dielectric layers of foam 24, 26 together to form the flexible and conformal antenna 10. Techniques for securing the layers together may also be used, as would be understood by one skilled in the art. The dielectric layers 24, 26 may have tapered dielectric constants to improve the scan angle. The dielectric layer 24 between the ground plane 30 and the dipole layer 20 may have a dielectric constant of 3.0 and the dielectric layer 24 on the opposite side of the dipole layer 20 may have a dielectric constant of 1.7, and the outer dielectric layer 26 may have a dielectric constant of 1.2 in a non-limiting example.

Figure 2:
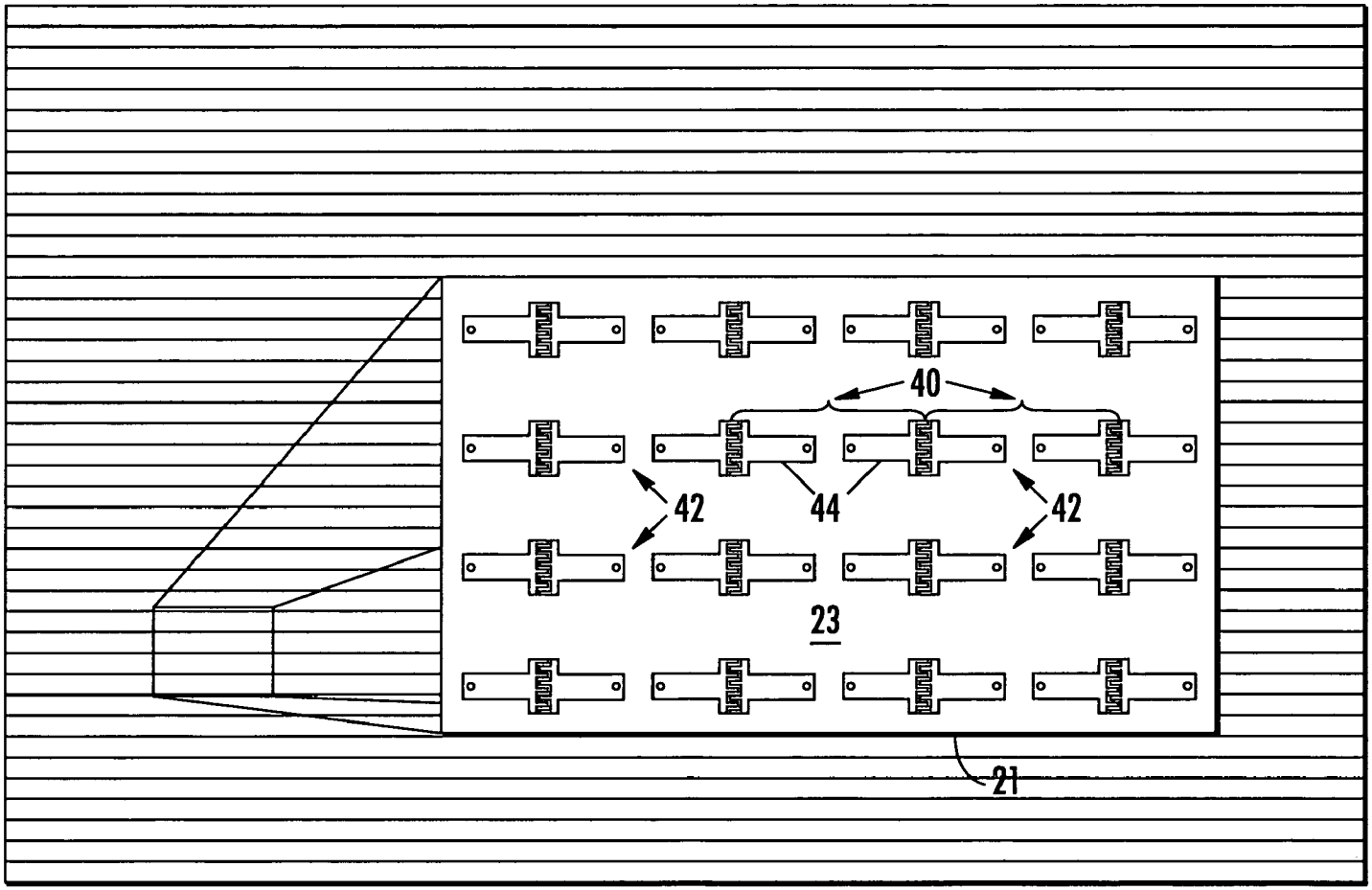
FIG. 2 is a schematic top plan view of a printed conductive layer of the wideband phased array antenna shown in FIG. 1.
Figure 3:
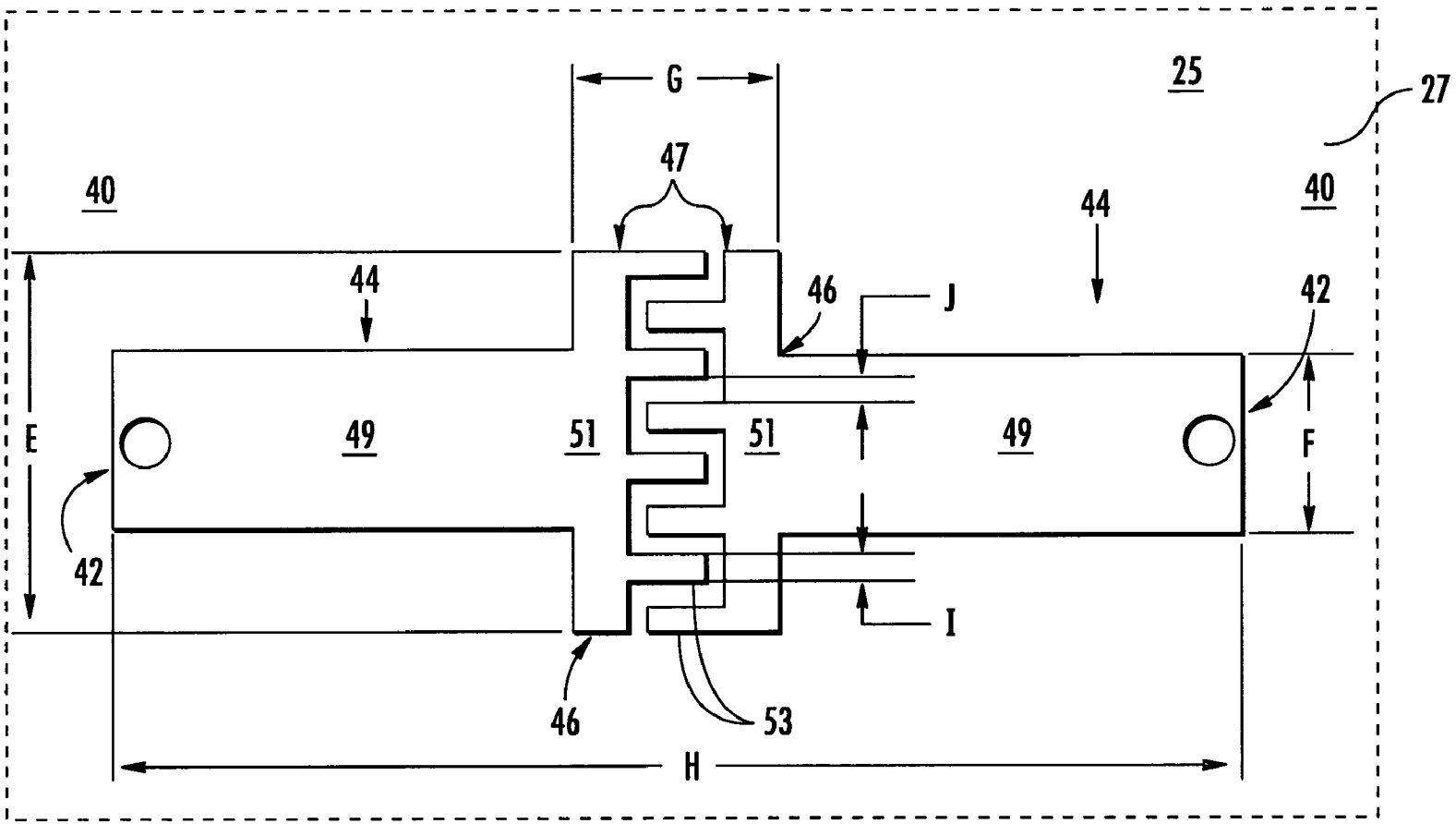
FIGS. 3 and 4 are enlarged schematic top plan views of spaced apart end portions of adjacent legs of adjacent dipole antenna elements in the wideband phased array antenna shown in FIG. 1.

The current sheet array (CSA) or dipole layer has typically closely-coupled, dipole elements embedded in dielectric layers above a ground plane. Inter-element coupling in these prior art examples is achieved with interdigital capacitors. Coupling can be increased by lengthening the capacitor "fingers" as shown in FIGS. 2 and 3. The additional coupling provides more bandwidth. It is believed that the capacitors tend to act as a bank of quarter-wave ($\lambda/4$) couplers. Coupling can be maintained to extend the bandwidth of a particular design. In this prior art example, the necessary degree of inter-element coupling can be maintained by placing coupling plates on separate layers around or adjacent to the interdigital capacitors. Shortening the capacitor "digits" or "fingers" moves the gain dropout out-of-band, but reduces coupling and bandwidth. Adding the coupling plates on these separate layers increases the capacitive coupling to maintain or improve bandwidth. The use of coupling plates on separate layers has been found to improve bandwidth in designs where no interdigital capacitors are used, such as shown in FIG. 4.

Figure 4:
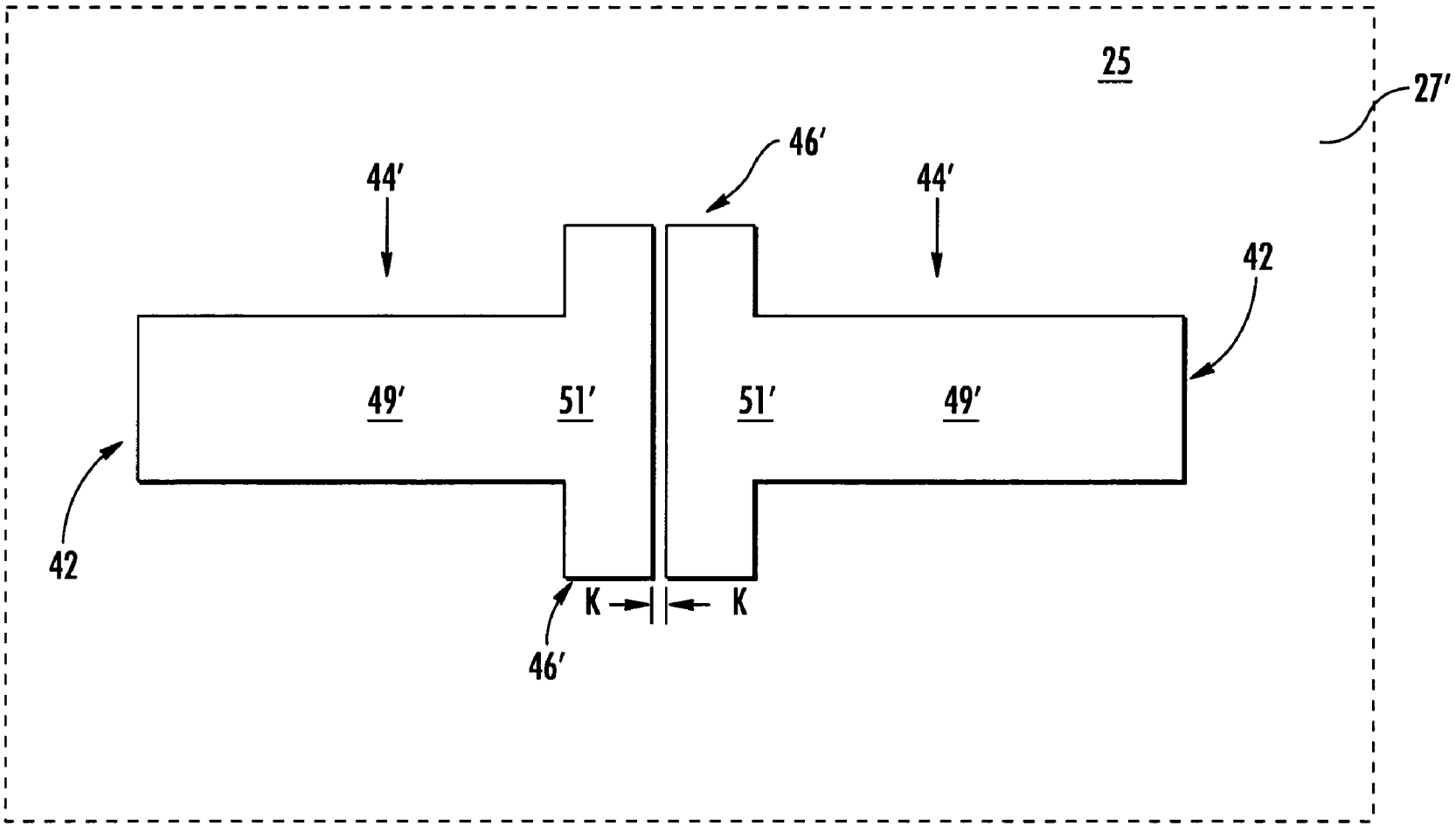

Referring now to FIGS. 2-4, the dipole layer 20 in this example is now described. The dipole layer 20 can be formed as a printed conductive layer as an array of dipole antenna elements 40 on a flexible substrate 23. Each dipole antenna element 40 includes a medial feed portion 42 and a pair of legs 44, extending outwardly therefrom. Respective feed lines are connected to each feed portion 42 from an opposite side of the substrate 23. Adjacent legs 44 of adjacent dipole antenna elements 40 have respective spaced-apart end portions 46 to provide increased capacitive coupling between the adjacent dipole antenna elements. The adjacent dipole antenna elements 40 have predetermined shapes and are positioned relative to each other to provide an increased capacitive coupling. For example, the capacitance between adjacent dipole antenna elements 40 may be between about 0.016 and 0.636 picofarads (pF), and preferably between about 0.159 and 0.239 pF in this prior art example.

As shown in FIG. 3, the spaced apart end portions 46 of adjacent legs 44 have overlapping or interdigitated portions 47. Each leg 44 includes an elongated body portion 49, an enlarged width end portion 51 connected to an end of the elongated body portion, and a plurality of fingers 53, for example four fingers extending outwardly from the enlarged width end portion.

Alternatively, as shown in FIG. 4, adjacent legs 44, of adjacent dipole antenna elements 40 may have respective spaced apart end portions 46' to provide increased capacitive coupling between the adjacent dipole antenna elements. In this embodiment, the spaced apart end portions 46' in adjacent legs 44' are formed as enlarged width end portions 51' connected to an end of the elongated body portion 49' to provide an increased capacitive coupling between the adjacent dipole antenna elements. For example, the distance K between the spaced-apart end portions 46' is about 0.003 inches.

As shown in FIGS. 3 and 4, coupling planes 25 illustrated in dashed lines can be positioned adjacent to the dipole antenna elements, preferably above or below the dipole layer 20. The coupling plane 25 can have metallization 27 on the entire surface of the coupling plane as shown in FIG. 3 or metallization 27' on selected portions of the coupling plane as shown in FIG. 4. Of course, other arrangements that increase the capacitive coupling between the adjacent dipole antenna elements are possible.

The array of dipole antenna elements 40 can be arranged at a density in the range of about 100 to about 900 per square foot. The array of dipole antenna elements 40 can be sized and positioned so that the wideband phased array antenna 10 is operable over a frequency range of about 2 to about 30 GHz, and at a scan angle of about ±60 degrees (low scan loss). The antenna may also have a 10:1 or greater bandwidth. It could include a conformal surface mounting and be easy to manufacture at a low cost, while maintaining lightweight characteristics.

For example, FIG. 3 is a greatly enlarged view showing adjacent legs 44 of adjacent dipole antenna elements 40 having respective spaced apart end portions 46 to provide the increased capacitive coupling between the adjacent dipole antenna elements. In this non-limiting example, the adjacent legs 44 and respective spaced apart end portions 46 have the following dimensions: the length E of the enlarged width end portion 51 equals 0.061 inches; the width F of the elongated body portions 49 equals 0.034 inches; the combined width G of adjacent enlarged width end portions 51 equals 0.044 inches; the combined length H of the adjacent legs 44 equals 0.276 inches; the width I of each of the plurality of fingers 53 equals 0.005 inches; and the spacing J between adjacent fingers 53 equals 0.003 inches. The dipole layer 20 may have the following dimensions: a width A of twelve inches and a height B of eighteen inches. In this example, the number C of dipole antenna elements 40 along the width A equals 43, and the number D of dipole antenna elements along the length B equals 65, resulting in an array of 2795 dipole antenna elements.

The wideband phased array antenna 10 has a desired frequency range of about 2 GHz to about 18 GHz, and the spacing between the end portions 46 of adjacent legs 44 is less than about one-half a wavelength at the highest desired frequency.

Figure 5:
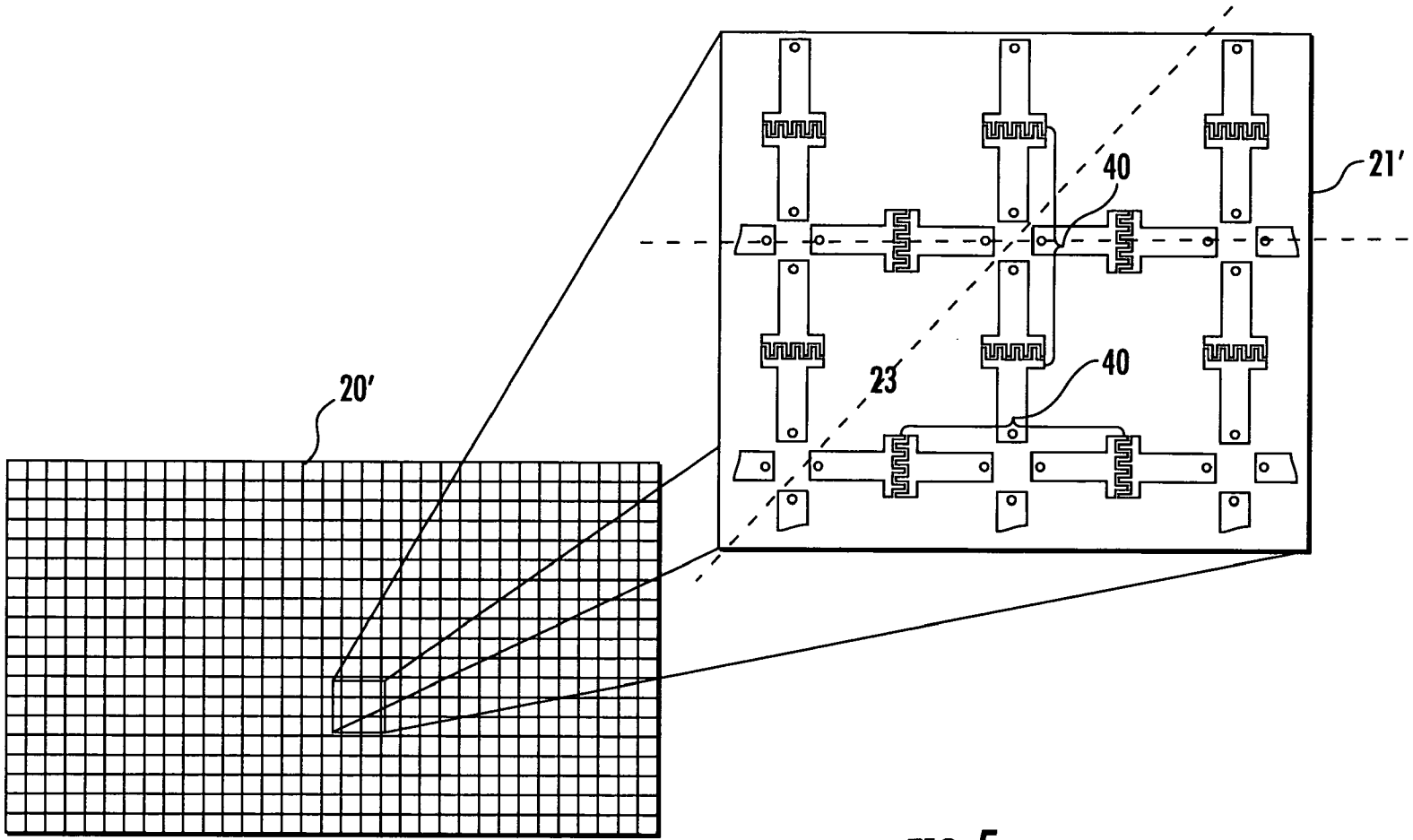
FIG. 5 is a schematic top plan view of another example of the printed conductive layer of the wideband phased array antenna similar to that shown in FIG. 1.
Figure 6:
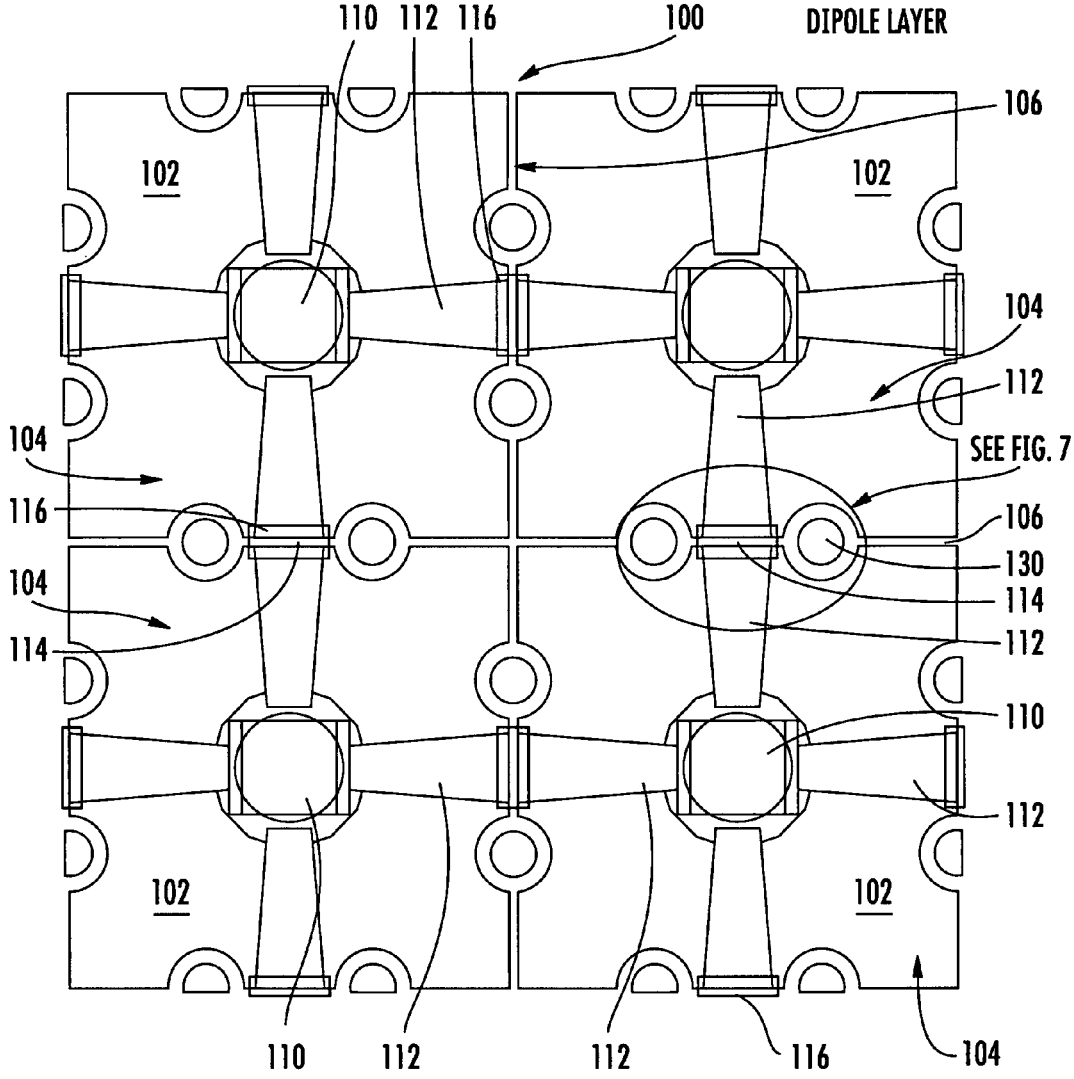
FIG. 6 is a schematic top plan view of a printed conductive layer of a wideband phased array antenna having a capacitor coupler, in accordance with a non-limiting example of the present invention.

Referring to FIG. 5, another embodiment of the dipole layer 20' includes first and second sets of dipole antenna elements 40, which are orthogonal to each other to provide dual polarization, as would be appreciated by one skilled in the art. An array of dipole antenna elements 40 can be formed on the flexible substrate 23 such as by printing and/or etching a conductive layer of dipole antenna elements 40 on the substrate 23.

Each dipole antenna element 40 includes a medial feed portion 42 and a pair of legs 44 extending outwardly therefrom. It is possible to shape and position respective spaced apart end portions 46 of adjacent legs 44 and provide increased capacitive coupling between the adjacent dipole antenna elements. The end portions 46 can include interdigitated portions 47 (FIG. 3) or enlarged width end portions 51' (FIG. 4). The ground plane 30 is preferably formed adjacent the array of dipole antenna elements 40, and one or more dielectric layers 24, 26 are layered on both sides of the dipole layer 20 with adhesive layers 22 therebetween.

This type of antenna 10 is scannable with a beam former, and each antenna dipole element 40 has a wide beam width. The layout of the elements 40 could be adjusted on the flexible substrate 23 or printed circuit board, or the bean former may be used to adjust the path lengths of the elements to place them in phase.

FIGS. 6-9 show an embodiment of a phased array antenna at the dipole layer 100 in accordance with a non-limiting example of the present invention, which uses a capacitor coupler over an air gap at end coupled antenna dipole elements where the antenna structure has been segmented at each antenna dipole element into separate "tiles" for capacitive coupling. Construction of the phased array antenna is similar to the construction of the phase array antenna shown in FIGS. 1-5, but the antenna as illustrated in FIGS. 6-9 is segmented at each dipole antenna element into the separate "tiles" corresponding to each antenna dipole element, and includes the capacitor coupler bridging the air gap formed at the edge coupled ends of the legs. The phased array structure is segmented at each dipole antenna element 102, similar to a subarray, such that any dielectric material has been removed from the layer at the antenna aperture down to the ground plane. Thus, the antenna and aperture is segmented to form array tiles shown at 104.

The cut-lines 106 extend from the substrate as an aperture to the ground plane and can be about 10 mils wide in this non-limiting example. Cut-lines 106 can be dimensioned depending on the "tile" dimensions, array configuration and other structural functions and end-use applications known to those skilled in the art. The feed points 110 for individual dipole antenna elements are illustrated. The individual dipole antenna elements 102 include their dipole arms 112 that extend outwardly and form an air gap 114 therebetween because of the edge coupling. There are no interdigitated "fingers." The capacitor coupler at the air gap provides the capacitive coupling.

Figure 8:
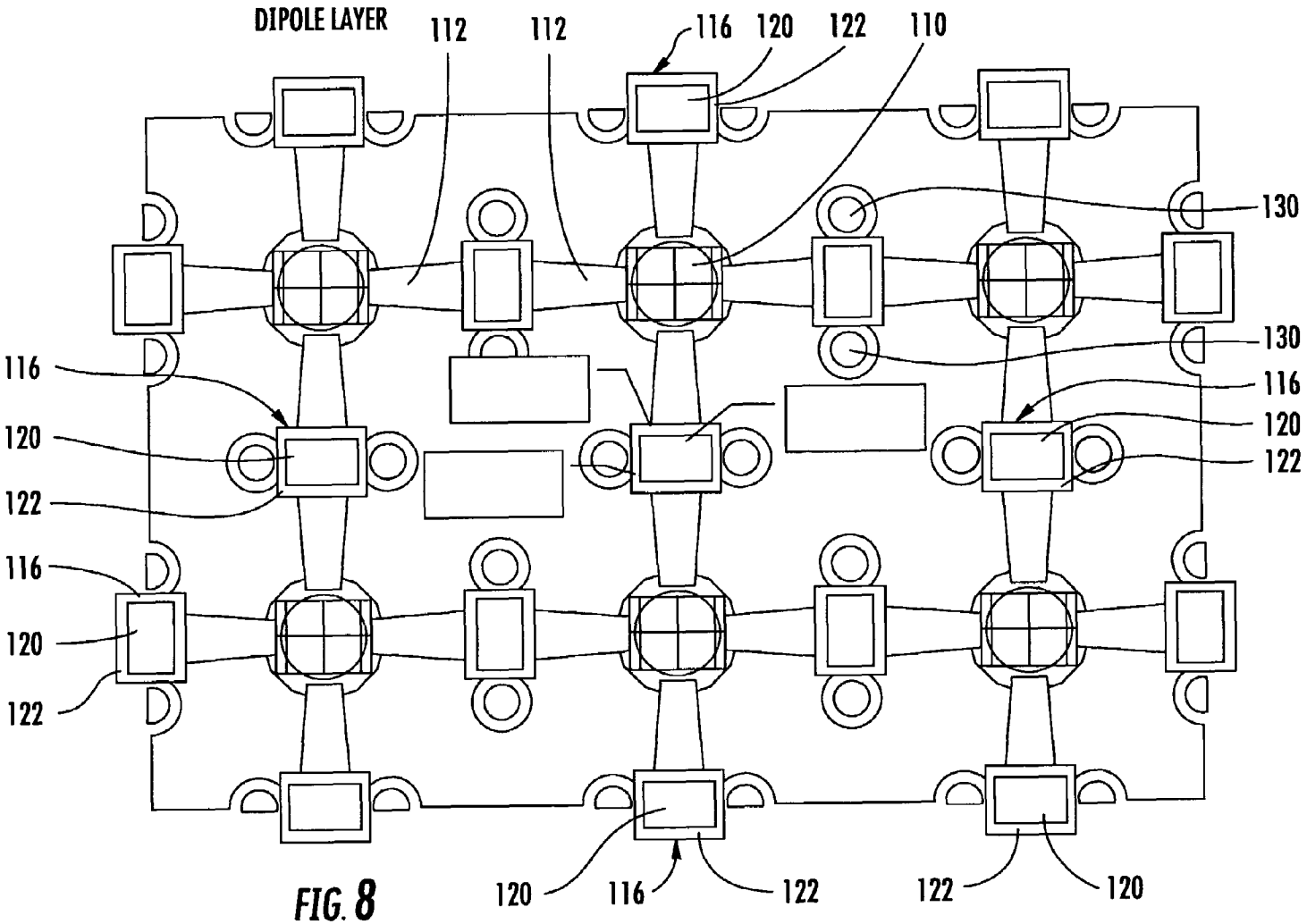
FIG. 8 is another top plan view of the printed conductive layer similar to FIG. 6 and showing capacitor couplers as support members and conductive sheets in accordance with a non-limiting example of the present invention.

In one non-limiting example, there is about a 6-mil air gap 114 between each of the edge coupled dipole arms 112. Each dipole arm 112 is edge coupled with another dipole arm of another dipole antenna element to which it is paired. At each air gap 114, a capacitor coupler 116 is positioned, such as formed by a conductive sheet 120 that is positioned on a support member 122 (carrier or appliance) and provides capacitive coupling (FIG. 8). The support member 122 can be formed as a segmented, metallized polyamide film such as sold under the designation of Kapton™ by Dupont.

Figure 7:
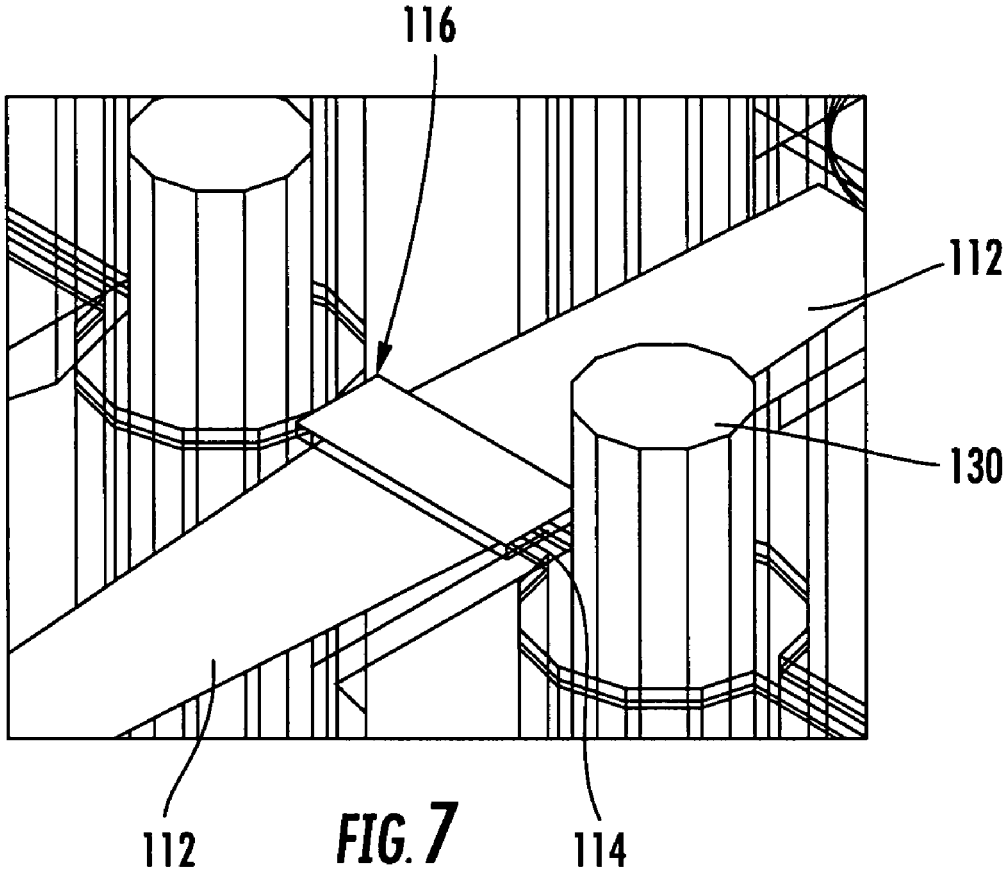
FIG. 7 is a fragmentary, isometric view showing the capacitor coupler over the air gap formed by edge coupled legs of dipole elements in accordance with a non-limiting example of the present invention.

In one non-limiting example, the metallized film layer such as formed from Kapton™ could be about 80 mils long by about 30 mils wide and about 5 mils thick. Another example could be Arlon 35N about 10 mils thick and forming the support member with a metal layer on top that is about 0.090 inches by about 0.80 inches, thus forming the capacitor coupler. The support member (carrier) could be formed from polyamide and similar materials and have a periphery that is slightly larger than the conductive sheet formed of metal to allow pick-and-place assembly. The support member is shown in FIG. 8, with the conductive sheet on top. A pick-and-place machine can grab onto the support member for quick pick-and-place assembly. FIG. 7 also shows circuit connectors 130 that extend vertically through the structure to connect to beam formers and other circuits. The conductive sheet could be formed from gold or copper foil or similar conductive material.

Figure 9:
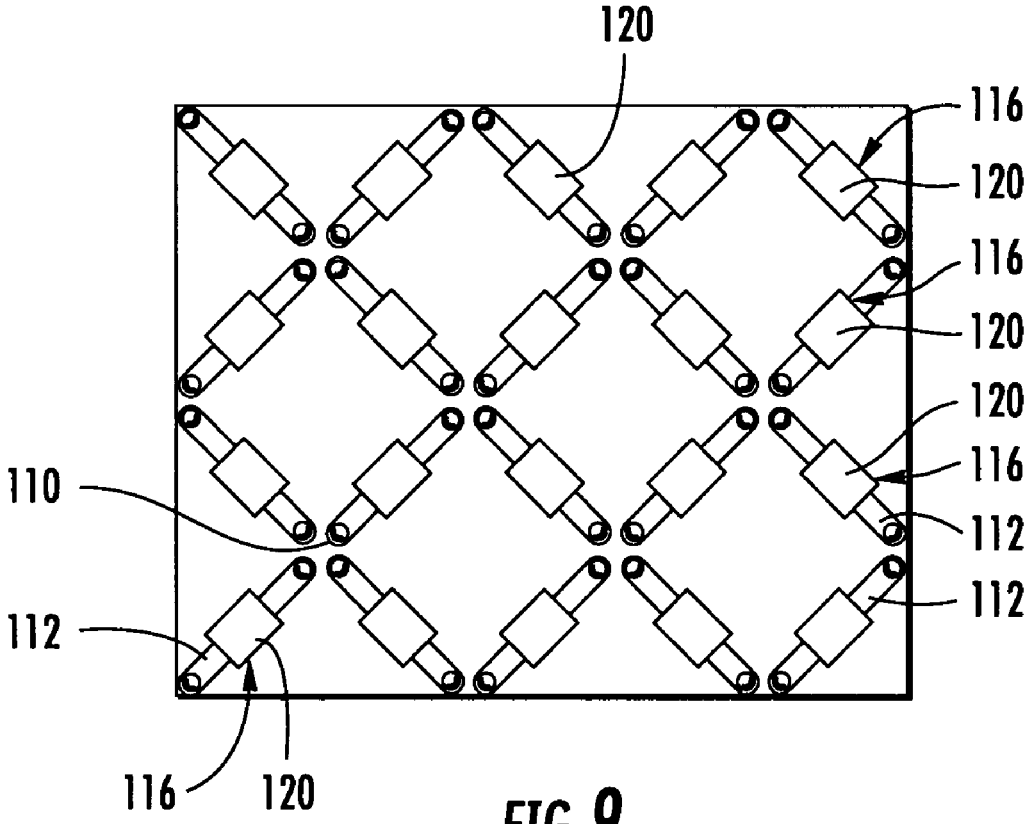
FIG. 9 is an image in plan view of the printed conductive layer such as shown in FIG. 8.

FIG. 9 shows an image with the feed points and the capacitor couplers extending over the air gap.

The foam used in the phased array antenna structure could be a Rohacell™ formed as a low dielectric foam.

Figure 10:
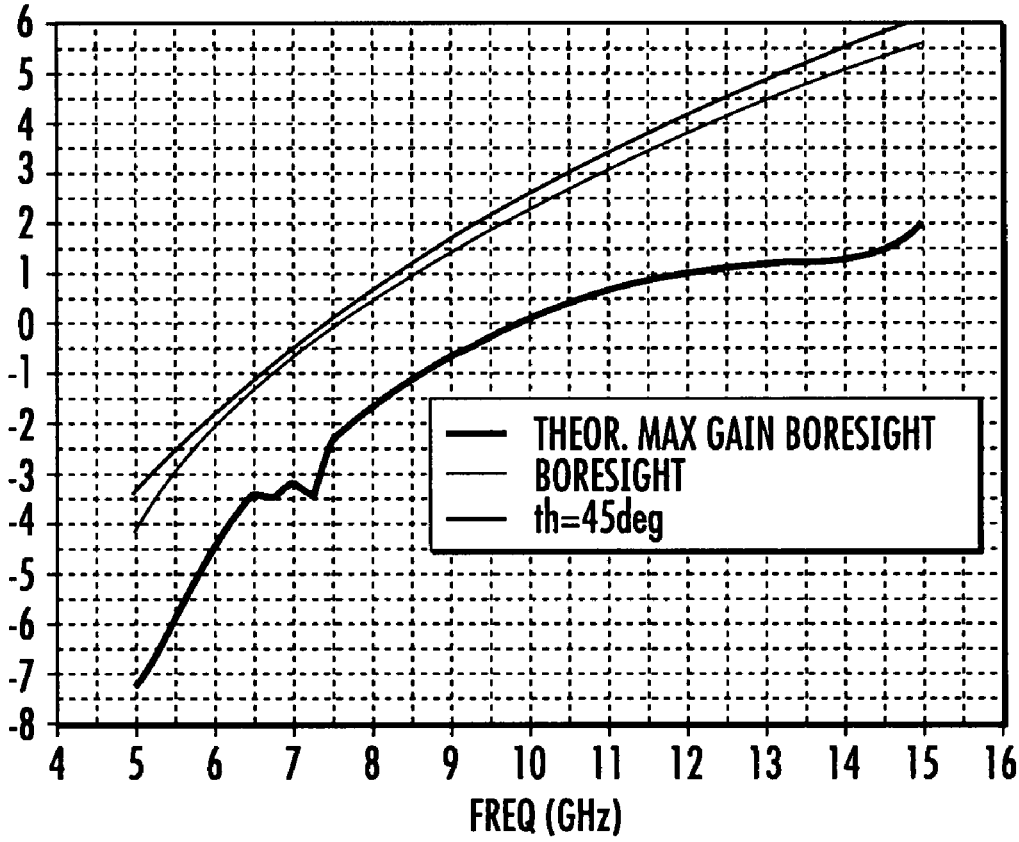
FIG. 10 is a graph of gain versus frequency of an original, non-tiled model of a phased array antenna showing the gain at both boresight and 45 degree scan.

FIG. 10 is a gain versus frequency graph of an original, non-tiled model of a prior art phased array antenna and showing the theoretical maximum gain at boresight, the predicted gain at boresight, and the predicted gain at a 45-degree scan. Frequency in Gigahertz is shown on the horizontal axis and gain in dbi is shown on the vertical axis.

Figure 11:
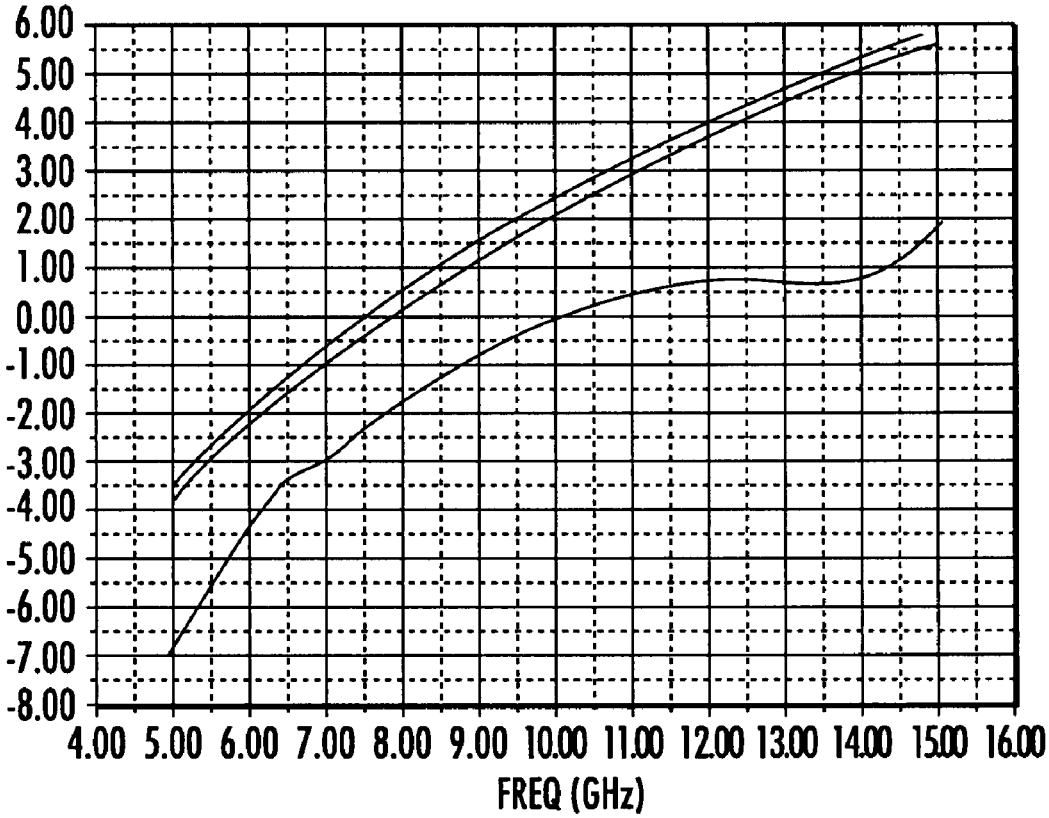
FIG. 11 is a graph showing the gain versus frequency performance of the modular, tiled construction of the phased array antenna with the capacitor coupler in accordance with a non-limiting example of the present invention.

FIG. 11 is a gain versus frequency graph similar to that shown in FIG. 10, but showing performance of the modular, tiled design, in accordance with a non-limiting example of the present invention, in which the dipole elements are formed as individual "tiles" and segmented such as shown in FIGS. 6-9 using the capacitor couplers at the air gap. The addition of the capacitor coupler to the modular design ensures that attainable performance does not degrade below the specification as clearly shown in the comparison of the graphs shown in FIGS. 10 and 11.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna, comprising:

a substrate that is segmented into a plurality of array tiles;

an array of dipole antenna elements formed on the substrate, each dipole antenna element positioned on a respective one of said array tiles, wherein each dipole antenna element comprises a medial feed portion and a pair of legs extending outwardly therefrom, adjacent legs of adjacent dipole antenna elements including respective spaced apart end portions forming a gap between the respective end portions and defined by separate tiles; and a capacitor coupler positioned at each respective spaced apart end portion of adjacent legs and bridging a gap for capacitive coupling respective spaced apart end portions of respective adjacent dipole antenna elements together.

2. The phased array antenna according to claim 1, wherein said capacitor coupler comprises a support member and conductive sheet thereon.

3. The phased array antenna according to claim 2, wherein said support member comprises a polyamide film layer.

4. The phased array antenna according to claim 2, wherein said support member includes a periphery that extends beyond said conductive sheet.

5. The phased array antenna according to claim 1, wherein said respective spaced apart end portions of adjacent legs define an air gap.

6. The phased array antenna according to claim 1, wherein the array of dipole antenna elements comprises first and second sets of orthogonal dipole antenna elements to provide dual polarization.

7. A phased array antenna, comprising:

a ground plane;

at least one dielectric layer applied adjacent the ground plane;

a substrate and array of dipole antenna elements thereon, said dielectric layer positioned between the ground plane and substrate, wherein said substrate is segmented at each dipole antenna element to form a plurality of array tiles such that each dipole antenna element is positioned on a respective one of said array tiles, wherein each dipole antenna element comprises a medial feed portion and a pair of legs extending outwardly therefrom, adjacent legs of adjacent dipole antenna elements including respective spaced apart end portions forming a gap between the respective end portions and defined by separate tiles; and a capacitor coupler positioned at each respective spaced apart end portion of adjacent legs and bridging a gap for capacitive coupling respective spaced apart end portions of respective adjacent dipole antenna elements together.

8. The phased array antenna according to claim 7, and further comprising cut lines extending from said substrate through the at least one dielectric layer to the ground plane for segmenting the substrate into the plurality of array tiles.

9. The phased array antenna according to claim 7, wherein said capacitor coupler comprises a support member and conductive sheet thereon.

10. The phased array antenna according to claim 9, wherein said support member comprises a polyamide film layer.

11. The phased array antenna according to claim 9, wherein said support member includes a periphery that extends beyond said conductive sheet.

12. The phased array antenna according to claim 9, wherein said support member respective spaced apart end portions of adjacent legs define an air gap.

13. The phased array antenna according to claim 9, wherein the array of dipole antenna elements comprises first and second sets of orthogonal dipole antenna elements to provide dual polarization.

14. A method of forming a phased array antenna comprising:

segmenting a substrate into a plurality of array tiles;

forming a dipole antenna element on each array tile, each dipole antenna element comprising a medial feed portion and a pair of legs extending outwardly therefrom, adjacent legs of adjacent dipole antenna elements including respective spaced apart end portions forming a gap between the respective end portions and defined by separate tiles; and capacitive coupling respective spaced apart end portions of respective adjacent dipole antenna elements together by positioning a capacitor coupler at respective spaced apart end portions of adjacent legs.

15. The method according to claim 14, which further comprises forming a ground plane and at least one dielectric layer between the ground plane and substrate.

16. The method according to claim 15, which further comprises cutting the substrate through the at least one dielectric layer to the ground plane for segmenting the substrate into array tiles.

17. The method according to claim 14, which further comprises forming the capacitor coupler as a support member and conductive sheet thereon.

18. The method according to claim 14, which further comprises forming the support member to have a periphery that extends beyond the conductive sheet.

19. The method according to claim 17, which further comprises forming the support member from polyamide.

20. The method according to claim 14, which further comprises forming first and second sets of orthogonal dipole antenna elements to provide dual polarization.

* * * * *